United States Patent [19]

Lawrence

[11] 4,337,936

[45] Jul. 6, 1982

[54] COMPACT SORTER

[75] Inventor: Frederick J. Lawrence, Tustin, Calif.

[73] Assignee: Gradco/Dendoki, Inc., Santa Ana, Calif.

[21] Appl. No.: 147,357

[22] Filed: May 7, 1980

[51] Int. Cl.[3] ..... B65H 29/58

[52] U.S. Cl. ..... 271/293

[58] Field of Search ..... 271/293, 294, 292

[56] References Cited

U.S. PATENT DOCUMENTS

| | | | |
|---|---|---|---|
| 3,848,868 | 11/1974 | Stemmle | 271/293 X |
| 3,938,802 | 2/1976 | Hartman | 271/293 X |
| 3,973,769 | 8/1976 | Cross | 271/293 X |
| 3,995,748 | 12/1976 | Looney | 271/293 X |
| 4,214,746 | 7/1980 | Redding | 271/293 X |
| 4,253,656 | 3/1981 | Landa | 271/293 |

*Primary Examiner*—Richard A. Schacher

*Attorney, Agent, or Firm*—Newton H. Lee, Jr.

[57] ABSTRACT

A sorting machine is provided to receive successive sheets from an outlet from a copying machine. The sorting machine has plural trays mounted so that the inlet ends of the trays move progressively past the sheet outlet in opposite directions, the inlet ends of the trays being relatively close together when positioned at either side of the outlet, but the inlet ends of adjacent trays being widely spaced to accommodate the incoming sheets from the outlet of the copier. The trays are fed past and spaced at the outlet by driven members at opposite sides of the tray which engage and shift stacked tray supports in succession. The other ends of the trays are supported for relative angular and longitudinal sliding movements on a vertically shiftable support timed with the feed of the inlet ends to minimize tray angle.

13 Claims, 11 Drawing Figures

(NON-SORT POSITION)

(START SORTING)

(MID SORTING)

(BOTTOM SORTING)

COMPACT SORTER

BACKGROUND OF THE INVENTION

Over the years, as copying machines have been more widely used to produce multiple sets of copies of multiple page documents, sorting machines have been devised to accommodate the copy sheets and sort them into collated sets as they leave the copy machine.

Efforts have been made to accommodate larger numbers of sets and to reduce the space occupied by the sorter, by shifting trays to facilitate the distribution of the sheets, as shown and described, for example in U.S. Pat. Nos. 3,774,902, 3,788,640 and 4,055,339.

Some the prior devices while adapting the sorter to receive a large number of sets or a large number of sheets per set have been adapted by a sheet transport to transfer sheets from the copying machine to a given tray or bin location, at which the sheet is deflected into the bin. As disclosed in my U.S. patent application Ser. No. 936,724, filed Aug. 25, 1978, space can also be effectively saved by nesting the sheet deflectors and extending their length.

Nevertheless, there has remained a need in the industry for a small, simple and compact sorter which can be applied to copiers, as original equipment, or as a later attachment, to receive copy sheets from the outlet of the copy machine and sort the sheets into a number of collated sets, without occupying a large space for the sorting apparatus. Such a compact sorter is the subject of my pending application Ser. No. 098,191, filed Nov. 27, 1979, for Compact Sorter, now U.S. Pat. No. 4,235,435. Another example of such a compact sorter is that made by Gradco-Dendoki, Inc., of Newport Beach, Calif., known as a "Mini-Sorter" and shown in pending application Ser. No. 098,546, filed Nov. 29, 1979, by DuBois and Hamma, which also shifts the inlet ends of the trays past the sheet outlet from the copier. Such compact or mini sorters are ideally suited to sorting relatively small numbers of sets, say eight or ten sets. However, there nevertheless has remained a need for a compact sorter which has the simplicity and cost and space efficiencies of the just-mentioned prior sorters, but which have larger set capacity, say the capacity to sort twenty sets and receive a large quantity of unsorted sheets in a non-sort mode of operation.

SUMMARY OF THE INVENTION

It is, therefore, a principal object of the present invention to provide new sorting apparatus which is improved to provide the existing need for a small or compact sorter with a relatively large number of trays or bins.

More particularly, it is an object of the invention to provide moving bin or tray sorting apparatus which is simple and reliable but has increased sorting capacity.

The bins or trays are adapted to be shifted vertically at their sheet inlet ends, adjacent to the copier, progressively in opposite directions, past the sheet outlet from the copier and to receive copies of successive originals while shifting in opposite directions, to minimize delay in the flow of copies to the sorter, while the other ends of the trays or bins are pivotally and longitudinally slidably supported by means which uniformly shift the latter ends of the trays or bins vertically to minimize angular disposition of the trays.

Shifting of the bins in opposite directions is accomplished by simple transfer means, whereby the bins are moved from a first, compact or closely spaced relation, at one side of the sheet outlet from the copier to a second, compact or closely spaced relation, at the other side of the sheet outlet from the sorter, while adjacent trays are widely spaced to accommodate sheet entry as the trays are intermittently stopped to receive a sheet.

The transfer or bin shifting means includes a pair of feed elements rotatably mounted adjacent each side of the bins or trays and adapted to engage trunnions at opposite sides of the bins in a successive manner to move them between the first and second closely spaced relations. The form shown herein includes cams simultaneously driven and halted, to provide the wide opening for a sheet.

The bins or trays pivot and slide longitudinally on their outer or distal ends on means which minimize variation of the incline of the pivotally moving trays as the trays move, at their inlet ends from below and above the inlet location, while adequate vertical bin spacing is maintained at the distal ends of the trays to receive a desired number of sheets as the inlet ends of the bins are widely vertically spaced at the fixed inlet location. Ideally, each tray may be at the same slight incline, but in practice, in the illustrated embodiment, in order to conserve space, the angle of inclination varies as the closely spaced inlet ends of the trays move upwardly and downwardly past the inlet location to and from closely spaced relation, and the other ends of the bins move vertically in uniformally spaced relation, in timed relation to the vertical movement of the inlet ends.

In the form shown, the sheet inlet ends of the bins or trays are supported on trunnions which stack in abutting engagement. The trunnions are successively shifted by a rotary cam past the sheet inlet position, to engage the trunnions of an adjacent tray and move the previously shifted tray or trays in closely spaced condition, the trays receive sheets while being shifted in opposite directions. While the feed cams shown are in the form of helical grooves in a rotary body, other transfer means may be employed which operate to successively engage and shift the trays, such as, for example, a linear Geneva movement. The trays are spring loaded in opposite directions.

Electrical drive and control means are provided which can, as well known, be independent of the copier machine controls or interfaced with the copier machine controls.

The present invention also provides a receiver for unsorted copies, which is shown in the form of a lower tray or bin which hangs from a sorting tray or bin above the receiver on collapsible or telescopic supports to occupy minimum space during the sorting operations.

This invention possesses many other advantages and has other purposes which may be made more clearly apparent from a consideration of the forms in which it may be embodied. The preferred form is shown in the drawings accompanying and forming part of the present application. It will now be described in detail, for the purpose of illustrating the general principals of the invention; but it is to be understood that such detailed description is not to be taken in a limiting sense.

DESCRIPTION OF THE PREFERRED EMBODIMENT

Figure 1:
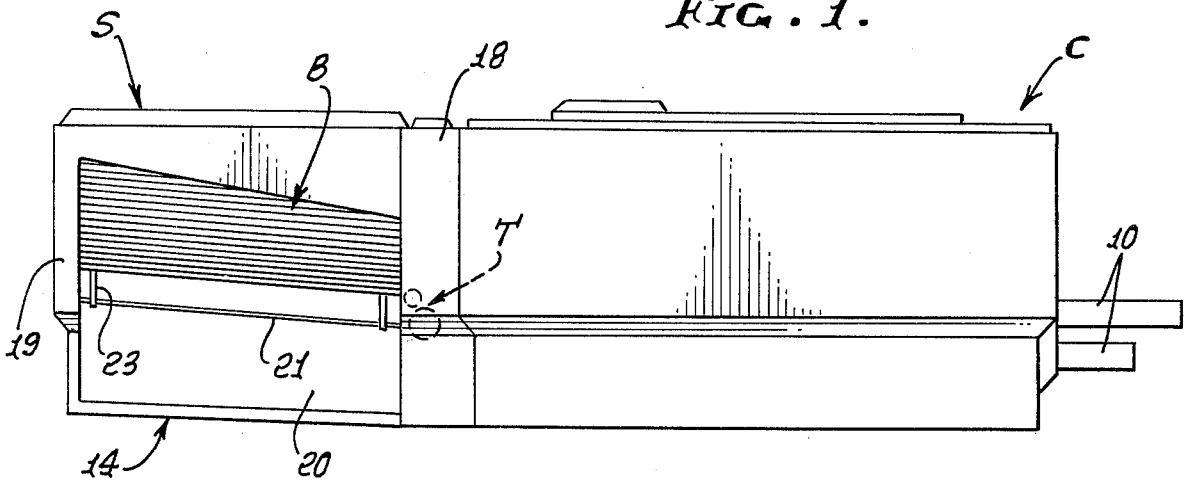
FIG. 1 is a front elevation, showing the sorter applied to a copying machine.

As seen in the drawings, a copy machine C has a sorter S applied thereto, whereby original sheets may be successively fed to the copier and a plurality of copies are sorted into collated sets. Such copy machines are well known and are the so-called plain paper copier type wherein the original is reproduced by the process of xerography or electrostatography.

It is not necessary to an understanding of the invention to disclose the specifics of the copying apparatus and process, since these are well known in the art. Schematic illustration of such copying apparatus and a description of its operation are found, for example, in U.S. Pat. No. 3,990,695.

In use, original material to be copied is supplied to the copier for reproduction of a selected number of copies which are transported to the sorter by transport rollers or other known transport means T incorporated in the copier. As is also well known, blank sheets are supplied to the copier from one or more supply cassettes 10, and are transported through the electrostatic or xerographic copying apparatus.

The sorter of the present invention is operable to receive, in a non-sort mode, a number of copies of a single sheet, or, in a sort mode, to receive and collate sets of copies of plural originals supplied to the copier in succession. In the illustrated sorter, provision is made for collating twenty sets of copies, but it will be understood that the principles of the invention may be employed in sorters capable of collating more or less than ten sets.

The copier C shown herein is a conventional copier which may be obtained without a sorter, in which case, the copies are supplied from the transport T to the usual receiver tray. The present invention enables the copier C to be retrofitted with the sorter S or to be originally equipped with the sorter in a simple manner.

The sorter may be attached to the copier in various manners. While a relatively longitudinally slidable support system may be provided, the form illustrated herein involves a mounting plate 11 which can be affixed to the frame of the copier. The plate 11 and the sorter have complimental hinge structure 12, whereby the sorter housing or frame can be shifted away from the copier to allow clearing a sheet jam at the outlet from the copier.

The sorter housing 14 is an elongated structure adapted to contain between an inner wall 18 adjacent the copier, and an outer end wall 19, remote from the copier, an array of trays or bins B of elongated form, which extend horizontally or lengthwise of the housing 14 for reception of copy sheets. Housing 14 is open at at least one side 20 to afford manual access to copies or sheets in the housing and may be open at both sides, either for access or ventilation. Below the lowermost bin or tray B is a receiver 21 onto which copies or sheets are fed when the apparatus is in a non-sort mode in which, in the form shown, the trays are in an upper position, above the sheet inlet.

The receiver 21 is supported beneath the lowermost tray 13 by telescopic connections 22 at the four corners of the receiver, the connections being in the form of slotted tabs or ears 23 on the receiver which extend upwardly and slidably receive tabs 24 on the lowermost tray or bin B. This structure allows the sorting trays to move downwardly without interference from the receiver, but the receiver tray forms the lower tray below the sheet outlet from the copier when the bins are shifted upwardly.

In the present construction, the bins or trays B are vertically shifted by shifting means 25, later to be described, at the outer ends 26, and at the inner ends 37, the trays or bins are vertically shifted by shifting means 28, later to be described. During the sorting of sheets, the bins are shifted vertically in sequence between locations above and below the sheet outlet from the copier provided in the mounting plate 11, through which copies are fed by transport means T.

As shown herein, the transport means T are shown in a form which specifically adapts the sorter for application to a particular form of copier which has its usual transport rollers spaced inwardly from the vertical plane of the end of the copier machine. In such a construction, auxiliary transport rollers 29 are provided and rotatably supported by the plate 11 adjacent an outlet guide 30 for the sheets. The auxiliary rollers are engaged with and driven by the transport rollers of the copier. In addition, the sorter frame supports knurled pinch rollers 31 which are positioned to press sheets against the auxiliary transport rollers to cause feeding of sheets from the copier to the sorter. In other installations it will be understood that the copy machine transport may discharge sheets directly into the sorter trays without need for auxiliary transport.

Figure 3:
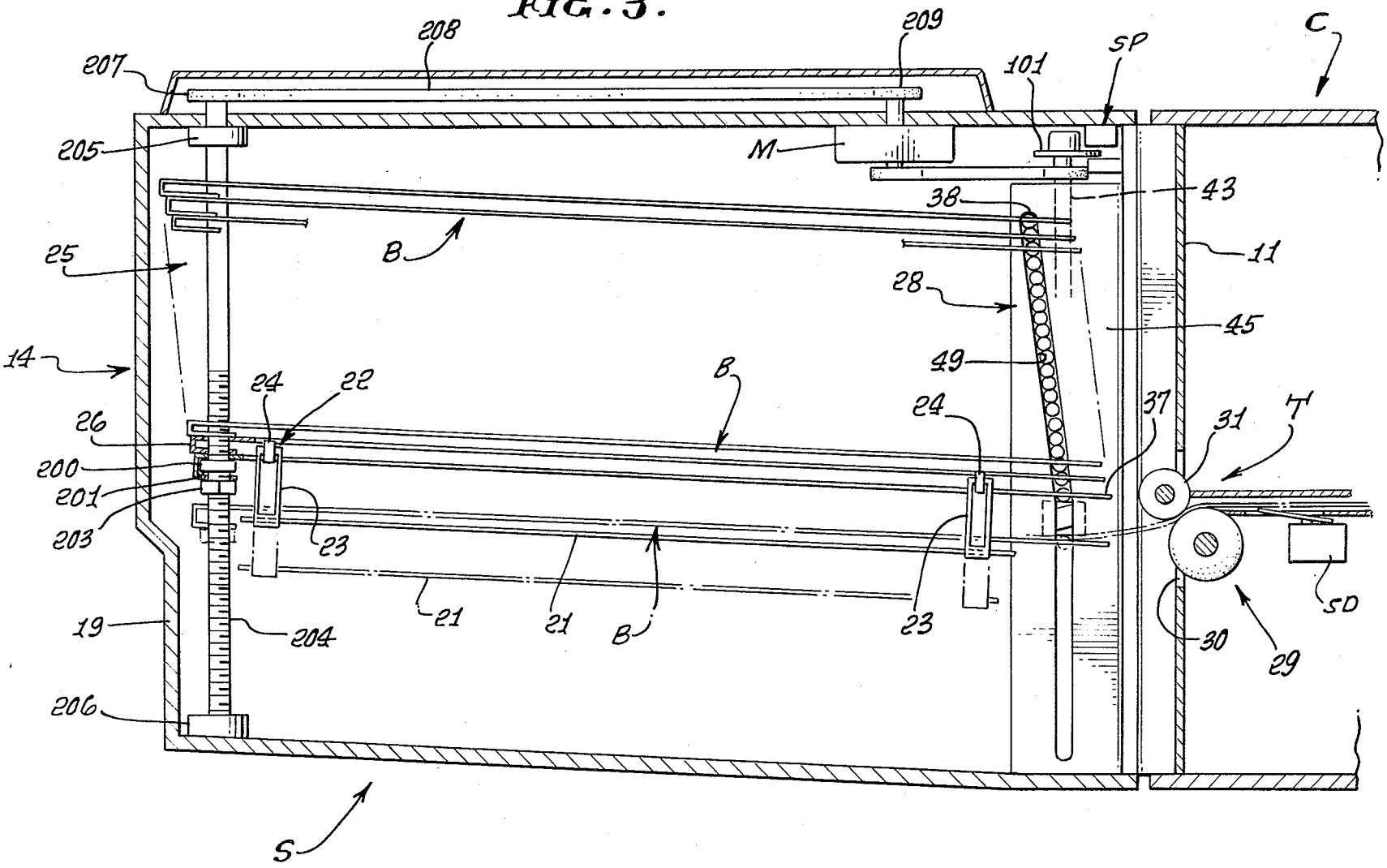
FIG. 3 is a vertical section on the line 3—3 of FIG. 2.
Figure 4:
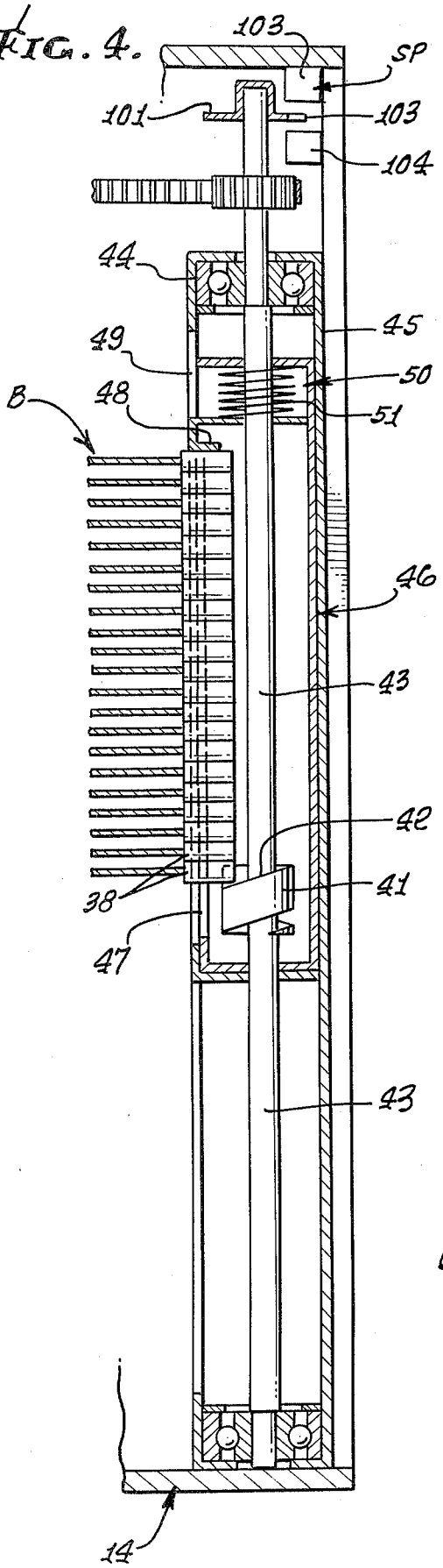
FIG. 4 is an enlarged vertical section on the line 4—4 of FIG. 2, showing the inlet ends of the trays in an upper position.
Figure 5:
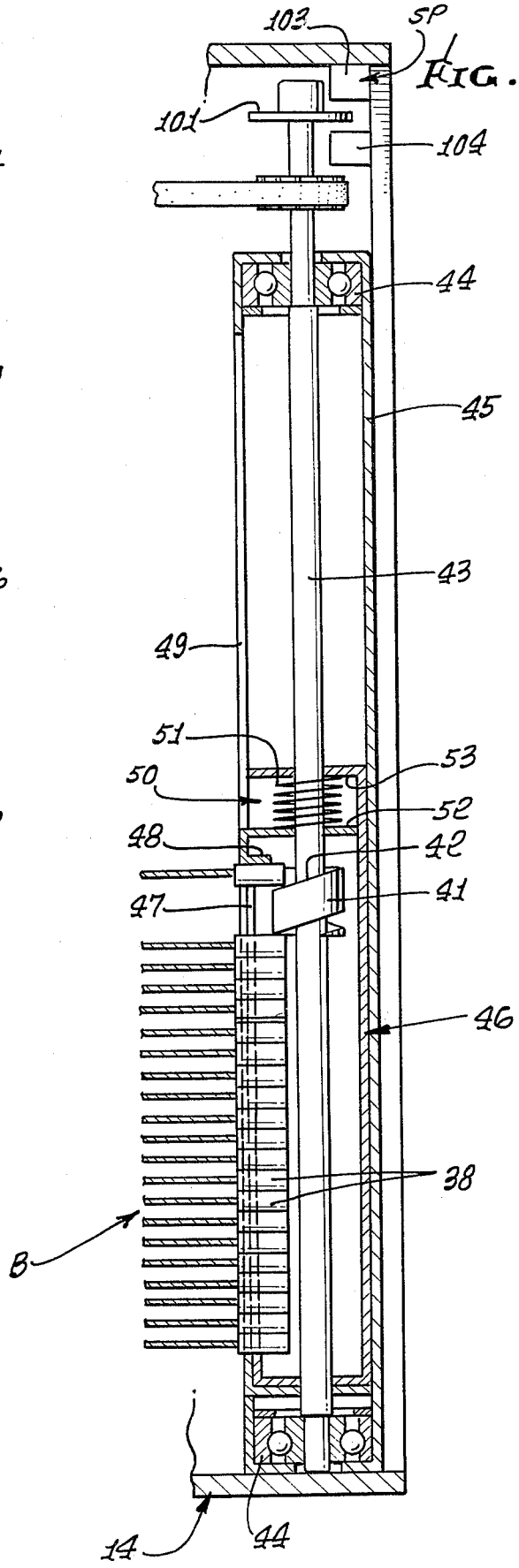
FIG. 5 is a view corresponding with FIG. 4, but showing the trays in a lower position.
Figure 6:
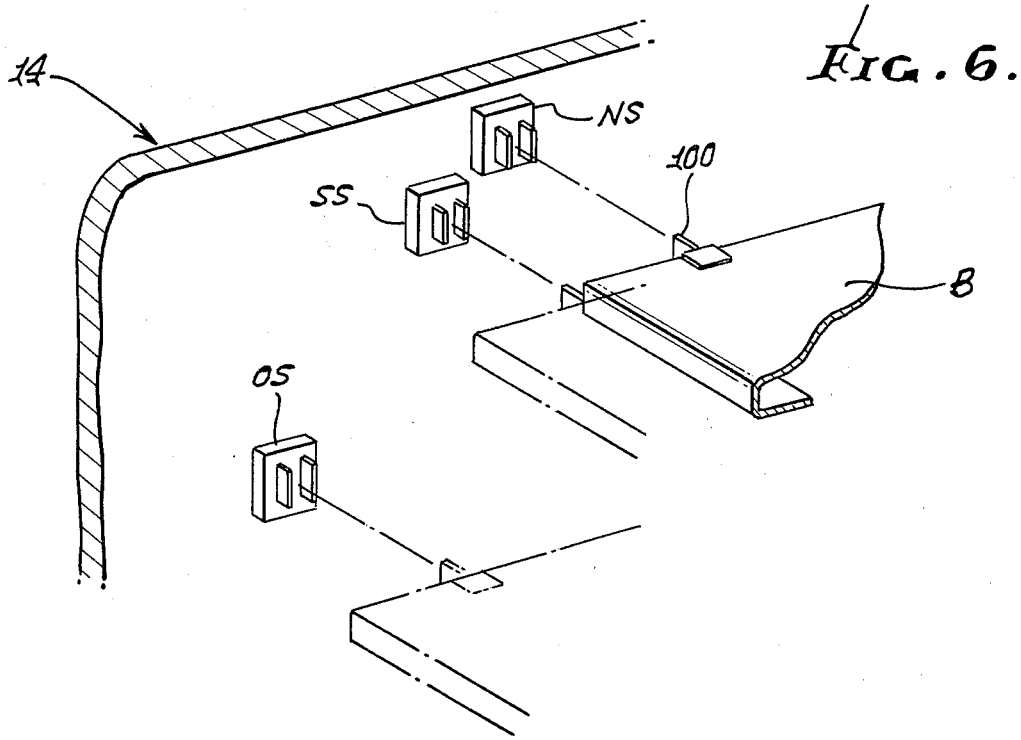
FIG. 6 is a perspective illustrating control switching means.

The bin or tray shifting means 28 can be best understood upon reference to FIGS. 3 through 5, wherein it will be seen that the inner ends of the trays are disposed adjacent to the adaptor plate 11 to receive paper sheets from the transport T. Spaced inwardly from the tray ends 37, each tray or bin B has a pair of trunnions 38 located on opposite sides of the tray and extending laterally outwardly. The trunnions are preferably formed as rolled portions of the trays, if the trays are of sheet metal, but may be molded on plastic trays. The diameter of the trunnions determines the vertical spacing between the ends 37 of the trays, when they are closely spaced above or below the sheet transport. Regardless of the length of the sheets, the sheets are dropped onto the tray with their trailing ends on the end section 37 of the respective trays. Thus, the spacing of the trays by the trunnions affords space for a number of sheets in a sorted set.

In any event, the trunnions 38 provide, at opposite sides of the trays, projections or lugs adapted to be successively engaged by driven members 41 and shifted vertically from one side of the sheet entry location and to be halted to provide a wide space between adjacent trays for receiving a sheet from the transport T.

Figure 2:
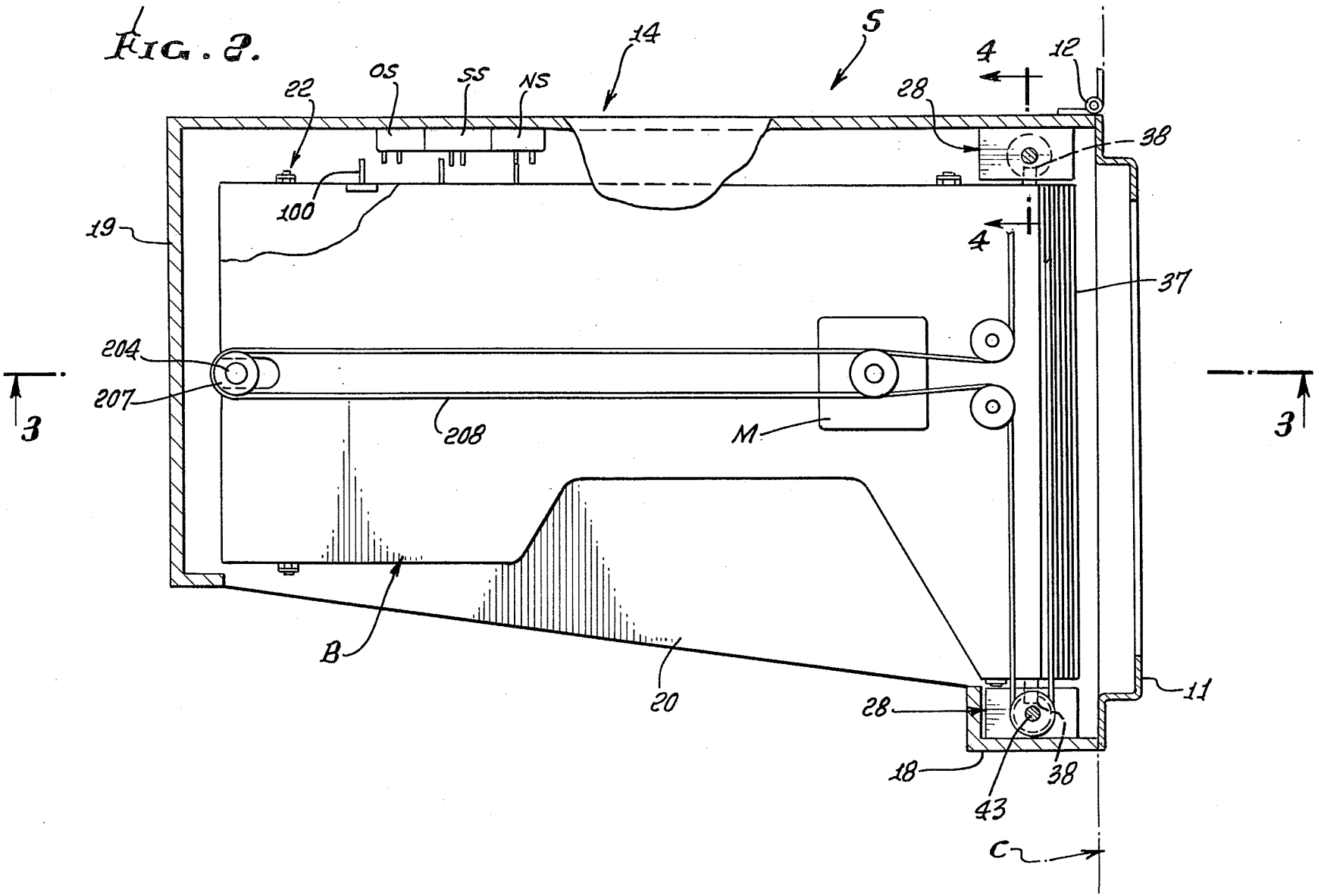
FIG. 2 is a top view, with the cover removed, showing the sorter apparatus.

In this form, the driven members 41 are helically extended cams or screws having a cam track 42 into which the lugs 38 extend and function as cam followers. Each cam 41 is mounted on a rotary shaft 43 mounted in upper and lower bearings 44 in supports 45 suitably mounted in or formed as part of the housing structure at opposite sides of the trays, as seen in FIG. 2.

The shafts 43 are adapted to be driven rotatively by a suitable motor M. mounted on housing 14, which drives timing chains or belts, under the control of a system to be later described.

Vertically shiftably disposed within each support tube 45 is a guide and loading member 46 having an elongated vertical opening 47 through which the trunnions extend laterally. A key 48 on the guide 46 projects into an elongated keyway 49 in the stationary support 45 to maintain alignment of the opposed slots 47 of the loading or guide members 46 of the bin shifters at opposite sides of the tray.

Spring means 50 are provided to load the trunnions vertically into engagement with one another and into the cam tracks 42. This spring means also supports the weight of the trays and the paper sheets thereon, during sorting operations.

The spring means includes a compression spring 51 disposed between a lower spring seat 52 and an upper spring seat 53 in the member 46, whereby to maintain a compression spring force on all of the trunnions 38, between the lower end of the lower spring seat 52 and the lower end of the slot 47 of tube 46, as best illustrated in FIG. 5. Various other spring arrangements may be employed so that the trunnions 38 are always forced towards the driven transfer member 41 for engagement in the transfer recess 42. This assures that each signal to the motor M, as later described, will result in the transfer of one tray upwardly or downwardly, during sheet sorting, or that the trays will be continuously transferred from a final position to a starting position to enable sorting operations to be initiated or non-sorting operation of the apparatus.

Before describing the present control system, reference to FIGS. 8 through 11 may be helpful to an understanding of the sequence of operations. In FIGS. 8 through 11, the arrow indicates the direction and location of sheet feed to the sorter apparatus.

Figure 8:
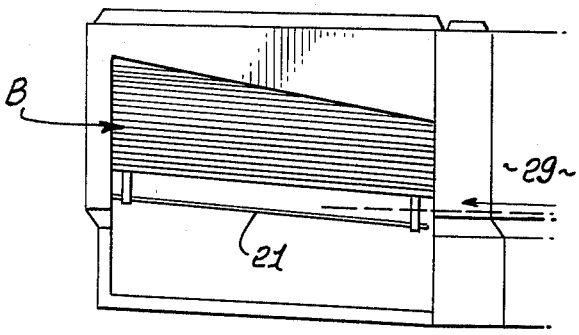
FIG. 8 is a front elevation showing the sorter in a non-sort condition.

As seen in FIG. 8, the trays or bin B are all in an upper "non-sort" position, at which a number of sheets (shown in broken lines) can be fed from the sheet inlet onto the tray 21.

Figure 9:
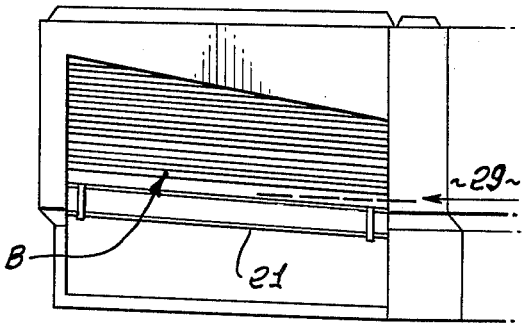
FIG. 9 corresponds with FIG. 8, but shows the apparatus in a start sorting condition.

As seen in FIG. 9, the apparatus is in a "START SORTING" position, in which the lowermost tray or bin B has been shifted downwardly to a position below the entry location 29, to provide a widely spaced gap between it and the next upper tray, for receiving a sheet.

Figure 10:
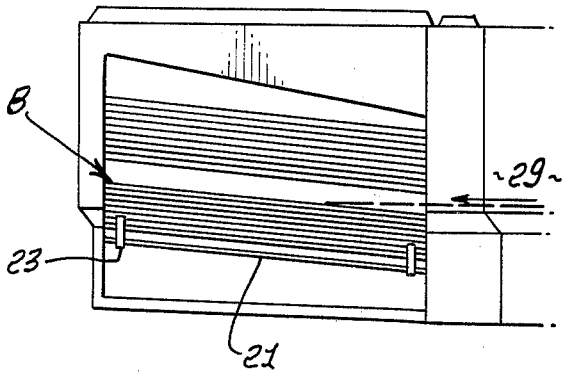
FIG. 10 corresponds with FIG. 8, but shows the apparatus in a mid-sorting condition.
Figure 11:
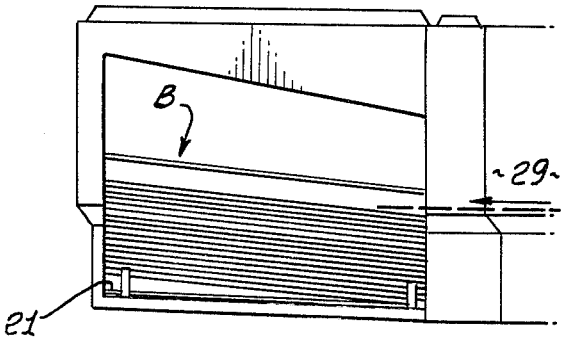
FIG. 11 corresponds with FIG. 8, but shows the apparatus in a bottom sorting condition.

In FIG. 10, the trays have been moved successively downwardly to what may be called "MID-SORTING" position, after copies have been fed onto the lower trays. If more copies are to be sorted, up to twenty in the illustrated embodiment, the operation will continue until the trays are in the "BOTTOM SORTING" position of FIG. 11.

However, if a number fewer than twenty are to be sorted, the tray shifting means is reversed following receipt of fewer number of copies, and the lower trays return to the position of FIG. 8, and so on until the total number of originals fed to the copier are reproduced and sorted into the illustrative sets.

As disclosed in my prior application, identified above, the outer ends of the trays or bins are slidably and pivotally mounted in slots in the frame structure. This is an arrangement which is satisfactory when a small number of trays are employed. However, when a larger number of trays are shifted vertically past the inlet location with the outer ends of the trays either sliding on supports in the frame or sliding one on the other, the angle of the trays relative to a horizontal plane becomes excessive during the sorting of a full number of sets.

Accordingly, in accordance with the present invention, the drive means 25 are provided to vertically shift the outer ends 26 of the bins in uniformly spaced relation. The lowermost bin or tray B is formed at its outer end to receive a cross-head 200, received in a channel 201 in the lowermost tray or bin. All of the trays above the lowermost tray rests on the lowermost tray in a manner permitting pivotal and longitudinal sliding of the respective outer ends of the trays, during the sorting operation.

The cross-head 202 is provided with a nut 203 threadedly engaged with a vertical screw shaft 204 journaled in bearings 205 and 206 in the upper and lower housing walls. The screw shaft 204 extends upwardly through the upper housing wall and has a sprocket 207 driven by a timing chain 208 by means of a drive sprocket 209 disposed above the housing and driven by the motor M. The pitch of the thread on shaft 204 is selected to provide the desired vertical movement of the outer tray ends as the inner ends of the trays are successively vertically shifted and widely spaced at the inner or inlet ends of the trays.

This second vertical feed 25 reduces the angle from horizontal of the bins or trays, to facilitate sheet entry.

Activation of the trays to the above referred to various positions is controlled by means which causes activation of motor M to turn the respective bin shifting members 41 and the shaft 204 through in the necessary direction, whereby the trays are lowered or elevated one by one at both ends, and sheets are fed by transport T while the the motor is idle and the trays are widely spaced at their inner ends.

These functions are controlled by a number of switching devices in circuit with the motor and certain logic means.

Certain of the trays or bins B will be seen to carry a switch actuator tab 100, adapted to control the motor by coaction with three vertically spaced sensors or switch controllers of any desired type. These switches include an upper non-sort switch NS, a start sort switch SS, slightly below the switch NS, and a lower, override or reverse switch OS. In addition, a shaft position switch SP, in the form of a light sensing device, or other position responsive switch, has a disc 101 on the shaft 43 for the bin shifter 41, having a gap 102 through which light passes, on each revolution of the shift between a light source 103 and a sensor 104. A sheet detecting switch SD is associated with the transport T of the copier, which is shown as an arm which can react to the passage of the trailing edge of a sheet from the copier transport T. As will later be described, the system, obviously, would include sort and non-sort selector switches and an on-off switch suitably located on the apparatus.

Figure 7:
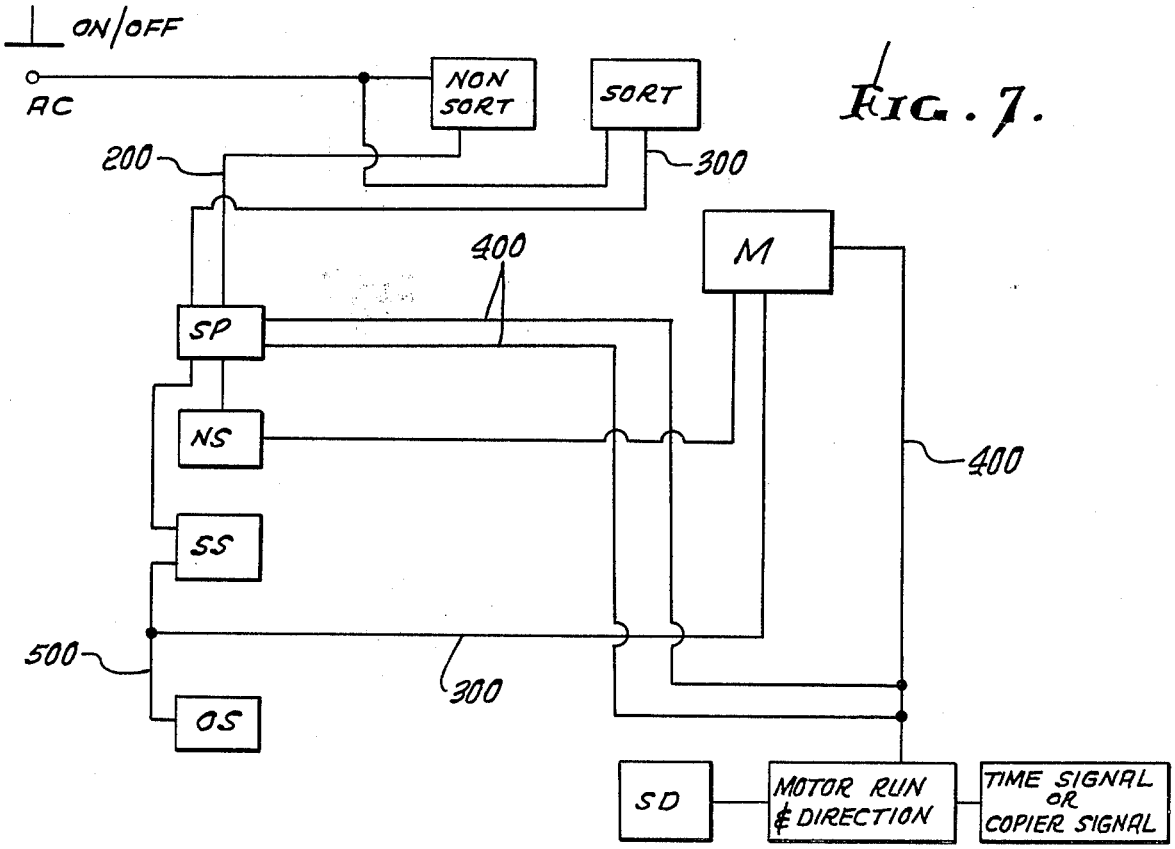
FIG. 7 is a diagram of illustrated control circuitry.

A diagram of the switching and logic circuitry is generally shown in FIG. 7. An on-off switch is adapted to energize the system under the control of NON-SORT and SORT switches. The NON-SORT switch may be automatically closed when the copier is turned on, but when closed the motor M is connected with an AC source through a circuit 200 to the shaft position switch SP and the non-sort switch NS, causing the motor to be driven continuously in a direction to move all bins upwardly until the non-sort switch NS is contacted by arm 100 to stop the motor when the shaft is in the position of FIG. 4, as determined by shaft position sensor switch SP, and shifter 42 is in position to engage the trunnion 38 of the lowermost bin, shown in full lines.

At this time, if sorting is desired, the SORT switch is closed to connect the AC source through circuit 300 with the shaft position switch SP the sort switch SS and the motor M. It will also now be noted that the motor M is also in a circuit 400 which is connected with the shaft position detector switch SP, a "MOTOR RUN & DIRECTION" logic device and the sheet detector switch SD. Activation of the system for sorting will cause one revolution of the bin feeders to shift the lowermost trunnions 38 and the cross-head 202 downwardly, as shown in broken lines in FIG. 3, thereby opening the lowermost bin to receive the first copy. Additional logic is also utilized in combination with the sheet detector swtich SD to time the successive activations of the motor M and direction controller in response to a time delay, or if integrated with the copier control logic a signal from the copier. For example, the time delay may be the simple time lapse between the operations of the copier to produce first copies of successive originals, as they are fed to the copier. This reverses the direction in which the motor runs, to reverse the movement of the bins from below the sheet inlet to above the sheet inlet.

The over-ride switch OS is in a parallel circuit 500 with the sort switch SS and will be activated after twenty copies, in the twenty bin sorter shown, have passed into the bins and the switch tab 100 on the bin B has moved downwardly to a position at which the uppermost bin has its trunnions in position to be moved upwardly. The switch OS, thus, can be an automatic shut-off switch if the copier has been set to make a number of sorted copies in excess of the bin capacity.

From the foregoing, it will be apparent that the present invention provides a unique, compact sorter apparatus which can be applied to the conventional copier and which can sort a number of copy sets in an effective manner, by reason of the manner in which the bins are shifted between compact positions above and below the sheet entry location and are widely spaced at the entry location.

I claim:

1. An improved sorting apparatus of the shiftable bin type including a frame structure having means for mounting the sorting apparatus on a copying machine at the sheet outlet from the copying machine, sorting bins shiftable relative to one another to provide a wide sheet entry between bins at said outlet, and means for shifting the bins, said bins having ends remote from said outlet pivotally arranged and ends adjacent said outlet mounted for shifting movement past said outlet, said means for shifting said bins engaging successive bins at said ends adjacent to said outlet to move the latter successively from one side of said outlet to the other, said means for shifting said bins also including means for shifting said remote ends uniformly in the direction of movement of said ends adjacent to said outlet, and including control means to intermittently effect operation of said shifting means in opposite directions following passage into successive bins from the copying machine of a selected number of sheets.

2. Improved sorting apparatus as defined in claim 1; said shifting means including rotary members engageable with successive bins and operative to effect longitudinal movement of said bins during shifting of said bins past said outlet, said remote ends of said bins being longitudinally shiftable during pivoting thereof.

3. Improved sorting apparatus as defined in claim 1, said shifting means including rotary members engageable with successive bins and operative to effect longitudinal movement of said bins during shifting of said bins past said outlet, and means for shifting said remote ends of said bins having means pivotally and longitudinally shiftably supporting said remote ends of said bins.

4. Improved sorting apparatus as defined in claim 1, including a tray below said bins for receiving successive sheets from said outlet when the ends of said bins adjacent said outlet are all positioned above said outlet, said control means including means for positioning all of said bins above said outlet, and collapsible means for suspending said tray from a bin above said tray in a location below said outlet when all of said bins are positioned above said outlet.

5. Improved sorting apparatus as defined in claim 1; including spring means acting on said bins to bias said bins towards said shifting means.

6. Improved sorting apparatus as defined in claim 1; said shifting means comprising a pair of rotary shafts one at each side of said frame structure and at opposite ends of said outlet, bin engaging members on said shaft operable to move said ends of said bins adjacent to said outlet as aforesaid, said means for shifting said remote ends of said bins including a rotary screw shaft, and motor means for driving all of said shafts rotatively and synchronously.

7. Improved sorting apparatus as defined in claim 6, said rotary members being helical cams, said bins having trunnions engageable with said helical cams.

8. An improved sorting apparatus comprising: a frame structure; a plurality of bin members shiftably disposed in said frame structure; means for successively moving said bin members in said frame between first and second positions at which said bin members are at opposite sides of a sheet entry location and in closely spaced relation and for widely spacing successive bins at said entry location to receive a sheet at said entry location; said means for moving said bin members comprising supports at opposite sides of said bin members in abutting relation at the ends of said bin members adjacent to said entry location when said bin members are in said first and second positions; driven bin shifting means engageable with successive supports to move said bins from one side of said entry location to the other; additional bin shifting means for shifting the ends of said bins remote from said entry location uniformly in the direction of movement of said ends of said bins adjacent to said entry location; and drive means to intermittently drive said bin shifting means.

9. An improved sorting apparatus as defined in claim 8; said bin shifting means comprising a spiral cam engageable with the opposite sides of said bin members to move said supports successively from engagement with the supports on the adjacent bin member at one side of said sheet entry location into engagement with the supports on the adjacent bin member at the other side of said entry location, said additional bin shifting means including a rotary drive screw.

10. An improved sorting apparatus is defined in claim 8; said drive means including a reversible electric motor, and including switching means responsive to movement of all of said bin members to either said first or second positions to reverse said motor.

11. An improved sorting apparatus as defined in claim 8; said means for moving said bin members being at one end of said bin members adjacent said entry location, said remote ends of said bin members being longitudinally slidably and pivotally supported; said means for shifting said ends of said bins adjacent to said entry location causing longitudinal and pivotal movement of said bins, and said means for shifting said remote ends of said bins including a driven member engaged with one of said bins to move said bins uniformly with said remote ends slidably and longitudinally shiftably supported one on the other.

12. An improved sorting apparatus as defined in claim 8, said bin shifting means being rotary members rotatable through one revolution to shift a bin member past said entry location, and including control means for said drive responsive to movement of a paper sheet into a bin member to cause intermittent rotation of said rotary members through one revolution.

13. An improved sorting apparatus as defined in claim 8, said bin shifting means being rotary members having a recess receiving said supports upon rotation of said rotary members in opposite directions and discharging said supports following shifting of said bin.

* * * * *